US006743995B2

(12) United States Patent
Groves et al.

(10) Patent No.: US 6,743,995 B2
(45) Date of Patent: Jun. 1, 2004

(54) QUIET PUSHBUTTON SWITCH

(75) Inventors: Sydney L. Groves, Rancho Palos Verdes, CA (US); Stephen M. Bartok, Rancho Palos Verdes, CA (US); Deo Del Rosario, Cerritos, CA (US)

(73) Assignee: Judco Manufacturing, Inc., Harbor City, CA (US)

( * ) Notice: Subject to any disclaimer, the term of this patent is extended or adjusted under 35 U.S.C. 154(b) by 0 days.

(21) Appl. No.: 10/163,947

(22) Filed: Jun. 6, 2002

(65) Prior Publication Data

US 2003/0226747 A1 Dec. 11, 2003

(51) Int. Cl.[7] ..... H01H 13/20
(52) U.S. Cl. ..... 200/527
(58) Field of Search ..... 200/526, 527

(56) References Cited

U.S. PATENT DOCUMENTS

| | | | | |
|---|---|---|---|---|
| 2,422,097 A | | 6/1947 | Hansen | 200/243 |
| 3,204,067 A | | 8/1965 | Brown | 200/527 |
| 3,226,991 A | | 1/1966 | Hartsock | |
| 4,476,359 A | * | 10/1984 | Bienwald | 200/527 |
| 4,713,498 A | | 12/1987 | Ludwig et al. | |
| 4,771,141 A | | 9/1988 | Flumignan et al. | |
| 4,906,808 A | | 3/1990 | Burgess et al. | |
| 5,001,316 A | | 3/1991 | Salaman | |
| 5,063,276 A | | 11/1991 | Woodard | |
| 5,132,499 A | * | 7/1992 | Valenzona et al. | 200/526 |
| 5,178,265 A | | 1/1993 | Sepke | |
| 5,186,316 A | | 2/1993 | Mortun et al. | |
| 5,493,089 A | | 2/1996 | Chasen et al. | |
| 5,586,645 A | * | 12/1996 | Bartok | 200/527 |
| 5,994,654 A | | 11/1999 | Benson | |

* cited by examiner

*Primary Examiner*—Renee Luebke
(74) *Attorney, Agent, or Firm*—Christie, Parker & Hale, LLP

(57) ABSTRACT

A pushbutton switch has a housing with a reciprocating plunger. The plunger is made in two parts with a hollow insert pressed in place to provide a slot inside the plunger with a longitudinally extending portion and a spirally extending portion. A rotatable shaft fits within the hollow insert and has a plurality of teeth at the lower end of the shaft. An electrical contact member with three circumferentially extending fingers is on the shaft over the teeth and with the fingers extending downwardly for contacting three electrical terminals in the housing to which contact may be made by external leads. When the plunger of the switch is depressed, the shaft moves downwardly and rotates without rotating the electrical contact member. When the plunger is released, the shaft also moves upwardly and rotates in the reverse direction whereupon a tooth engages a pawl extending downwardly from the contact member, advancing the contact member in rotation and changing the state of the switch.

21 Claims, 12 Drawing Sheets

QUIET PUSHBUTTON SWITCH

BACKGROUND

The present invention relates to pushbutton switches for use in electrical circuits; for example, an ON-OFF switch in which electrical contact is made when the plunger of the switch is pressed once and contact is broken when the plunger is pressed a second time. It may also be useful for an ON-ON-OFF switch, where there are two different ON positions and an OFF position. It might also be useful for a single pole, double throw switch, where there are two different ON positions and one OFF position. A switch may be an ON-ON switch, where electrical contacts are switched between a common lead and either of two alternate other leads. etc.

A variety of electrical pushbutton switches are well known, with quite a variety of internal operating mechanisms. Small pushbutton switches are desirable for automotive applications, for example, and many of such switches are somewhat noisier than desired. It is preferable to have a pushbutton switch that is quieter than most that are presently available. Many switches have wiping or sliding contact between terminals as the switch is opened or closed. It is desirable to minimize friction in such a wiping contact, if for nothing else but to minimize wear. Light wiping contact pressure is therefore desirable.

It is also desirable that the change of state of the switch does not occur when the plunger of the switch is depressed, but only commences when the plunger is released and moves upwardly. This is known as a "stable-ON feature," which avoids a problem of intermittent contact (e.g., a flickering light bulb) when the plunger of the switch is partly depressed or vibrated.

BRIEF SUMMARY OF THE INVENTION

In an exemplary embodiment, the pushbutton switch comprises a body or housing with two or three electrical terminals, for example. A pushbutton plunger is mounted for reciprocation in the housing for operating the switch. There is a rotatable contact member for contacting the terminals, depending on the rotational position of the contact member for making or breaking an external circuit. A shaft engages the plunger so that it is moved downwardly upon downward depression of the plunger and rotates in response to movement of the plunger. A ratchet rotates the contact member in response to rotation of the shaft.

BRIEF DESCRIPTION OF THE DRAWINGS

These and other features and advantages of this invention will be appreciated from the following description of presently preferred embodiments when considered in connection with the accompanying drawings in which.

DESCRIPTION

Figure 1:
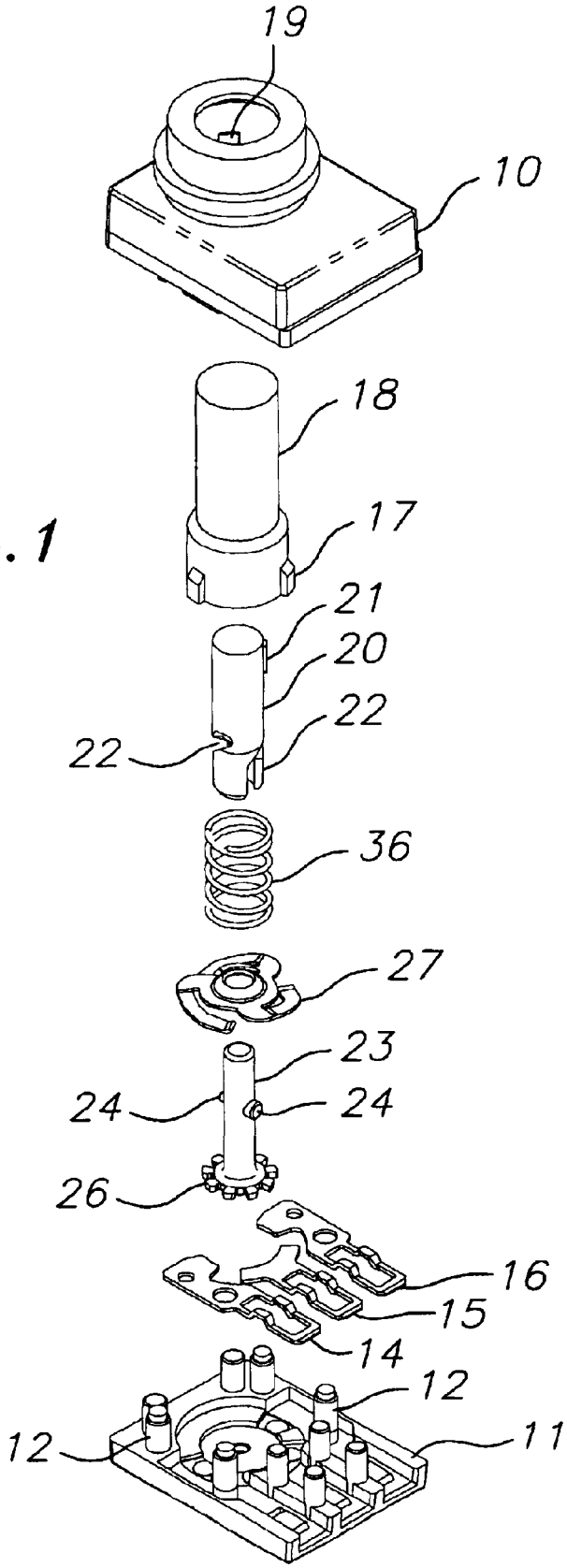
FIG. 1 is an exploded perspective view of a pushbutton switch, looking somewhat downwardly toward the switch.

A pushbutton switch has a housing formed of a switch body 10 and a cover 11. The housing is assembled and kept together by pressing pins 12 on the cover into holes 13 in the body with an interference fit. In the illustrated embodiment, three electrical terminals 14, 15 and 16 fit into the cover. The electrical terminals provide means for connecting the switch to external leads. No additional description is needed for the body, cover and terminals, since they are nearly conventional, and no additional information is needed for an understanding of this invention.

It may be kept in mind that such a pushbutton switch is actually quite small, not nearly as large as suggested by the drawings. Thus, a typical switch may have a housing that is only 13 by 18 millimeters.

Figure 2:
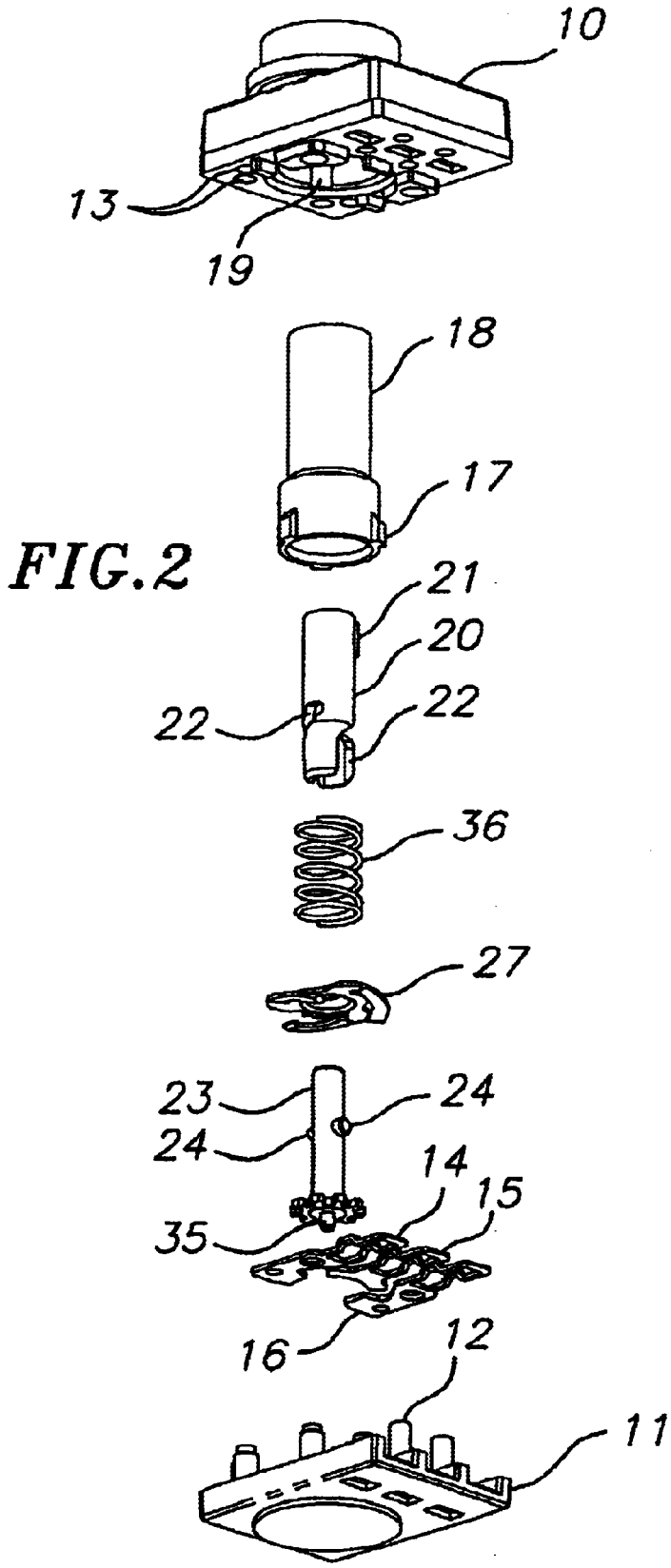
FIG. 2 is another exploded perspective view looking somewhat upwardly toward the switch.

As a matter of convention for this specification, the body is considered to be the top of the switch and the cover is considered to be the bottom. For example, when the plunger of the switch is pressed, it moves downwardly. Similarly, the view of FIG. 1 looks generally downwardly toward the switch, and FIG. 2 looks generally upwardly toward the switch. The switch may, of course, be used in any orientation.

There are three keys 17 on the outer part of the plunger 18 of the switch. These keys fit into matching keyways 19 in the housing to permit the plunger to reciprocate without rotation. The plunger includes a hollow insert 20, which fits into the outer part 18. This is illustrated separately herein, since it is manufactured in a separate piece from the balance of the plunger, so that the internal structure of the plunger can be injection molded. The insert is pressed into the plunger with an interference fit so that, when assembled, it becomes a permanent part of the plunger. A key 21 on the insert fits into a longitudinal slot 25 inside the plunger to assure appropriate alignment of the insert within the plunger.

Figure 3:
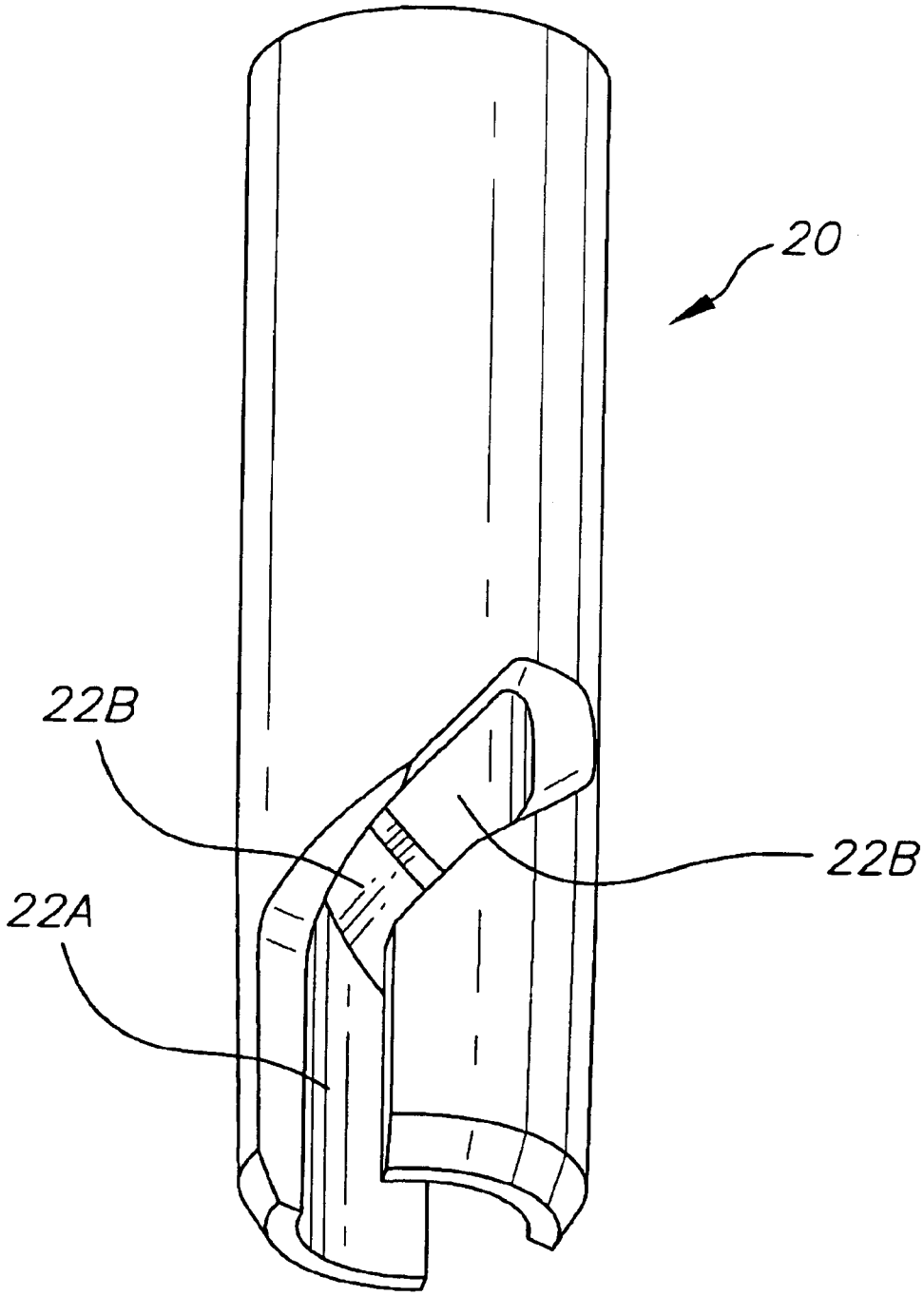
FIG. 3 is an additional perspective view of a plunger insert which forms a part of the plunger of the switch.
Figure 4:
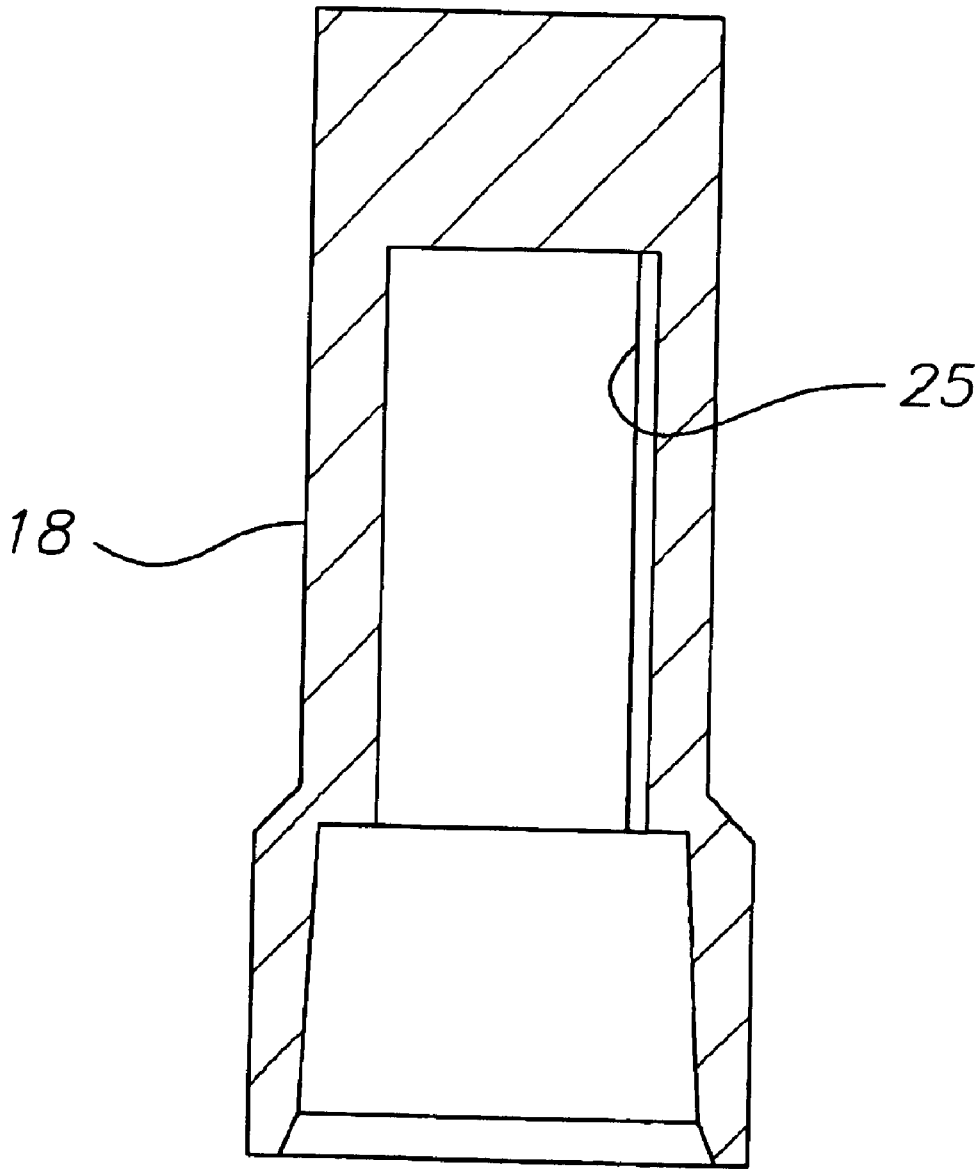
FIG. 4 is a longitudinal cross-section of the outer portion of the plunger.

The insert includes two slots 22. Each of the slots has a lower portion 22A extending longitudinally and connecting to an upper portion 22B that extends diagonally or spirally upwardly and circumferentially (FIG. 3).

A shaft 23 fits into the assembled plunger, i.e., within the hollow insert portion of the plunger. A pair of opposite pins 24 extend laterally from the side of the shaft somewhere near the middle of its length. These two pins fit into the two slots respectively in the plunger insert. The pins and slots serve as guides or cams for relative movement of the shaft upwardly within the plunger and diagonally upwardly, as described below. The shaft is kept centered in the housing by the hollow plunger and a short axial pin 35 which fits into a cavity in the cover 11.

Figure 5:
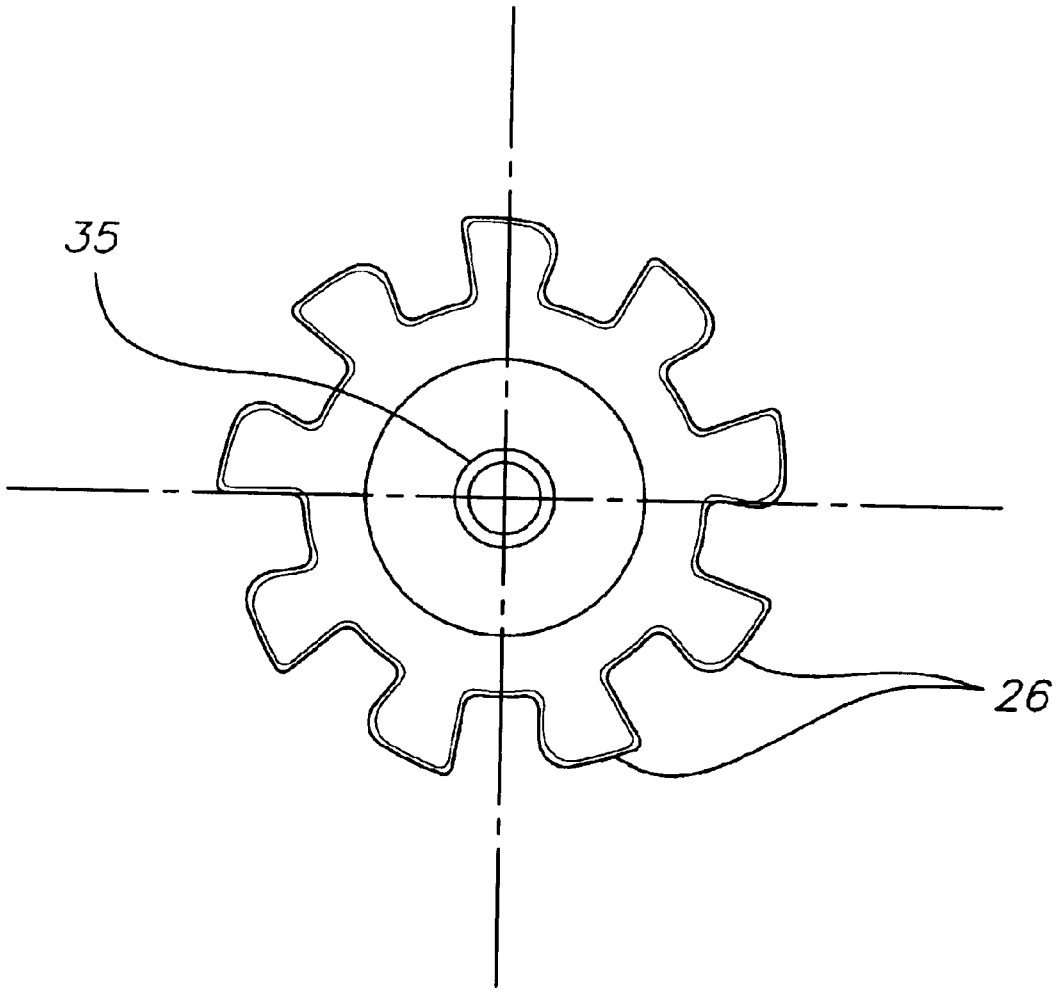
FIG. 5 is a bottom end view of a shaft that fits into the plunger.

At the lower end of the shaft, there is a small flange with a plurality of teeth 26 radiating from the shaft. In the illustrated embodiment, there are nine teeth (FIG. 5). In this embodiment, one of the pins on the shaft and its corresponding slot in the plunger are relatively wide. The opposite slot and pin are relatively narrow. The reason for doing this is that this permits assembly of the shaft into the plunger in only one rotational position. In an embodiment with an odd number of teeth on the shaft, it is desirable that the leading edge of a tooth lies at a known location, for example, on a centerline of the switch. This can be seen, for example, in the illustration of FIG. 9. Having a structure that permits assembly of the shaft into the plunger in only one position, assures correct alignment of the teeth on the shaft with the housing of the switch, hence with the terminals.

An electrical contact member 27 fits over the shaft 23 so that the center portion of the contact member lies above the toothed flange at the lower end of the shaft. There is a generally conical raised lip around the center hole of the contact member which engages the flange at the lower end of the shaft to keep the contact member centered. In this embodiment, there are three circumferentially extending fingers 29 on the contact member, which are bent downwardly far enough that the ends of the fingers extend below the teeth on the shaft so as to make electrical contact with the terminals fixed in the housing. It will be apparent that the fingers are radially further from the center of the shaft than are the ends of the teeth. Preferably, the electrical contact member is made of beryllium copper so that the contact fingers are only slightly bendable, only enough to assure good wiping electrical contact with the respective terminals.

There is a smaller finger 31 which is also bent downwardly on the electrical contact member. This finger is bent downwardly only enough that the end can engage the leading edge of a tooth to act as a pawl with the teeth acting like a rachet. This pawl finger is narrower and hence more easily flexible than the contact fingers.

As mentioned above, there are three electrical contact terminals 14, 15 and 16 placed in the cover and held there by the body of the housing. Each of the terminals has a pair of shallow raised and widened areas 32 spanning an opening 33. These raised areas provide for electrical contact with external leads plugged into the housing of the switch from either an end or the bottom of the switch. Further toward the center of the switch, each of the terminals has an electrical contact pad 34 for electrical contact with fingers on the rotatable contact member 27. The center terminal has a somewhat larger contact pad (i.e., extending further circumferentially) than the outer two terminals. The circular holes 30 illustrated through the outer terminals are clearance for pins between the cover and body which also help position the terminals.

As described below, the contact member rotates 40° (with a nine tooth shaft) each time the plunger of the switch is depressed and released. The contact member is rotated 40° upon each actuation of the switch by the leading edge of a tooth engaging the pawl 31 extending downwardly from the contact member.

Figure 9:
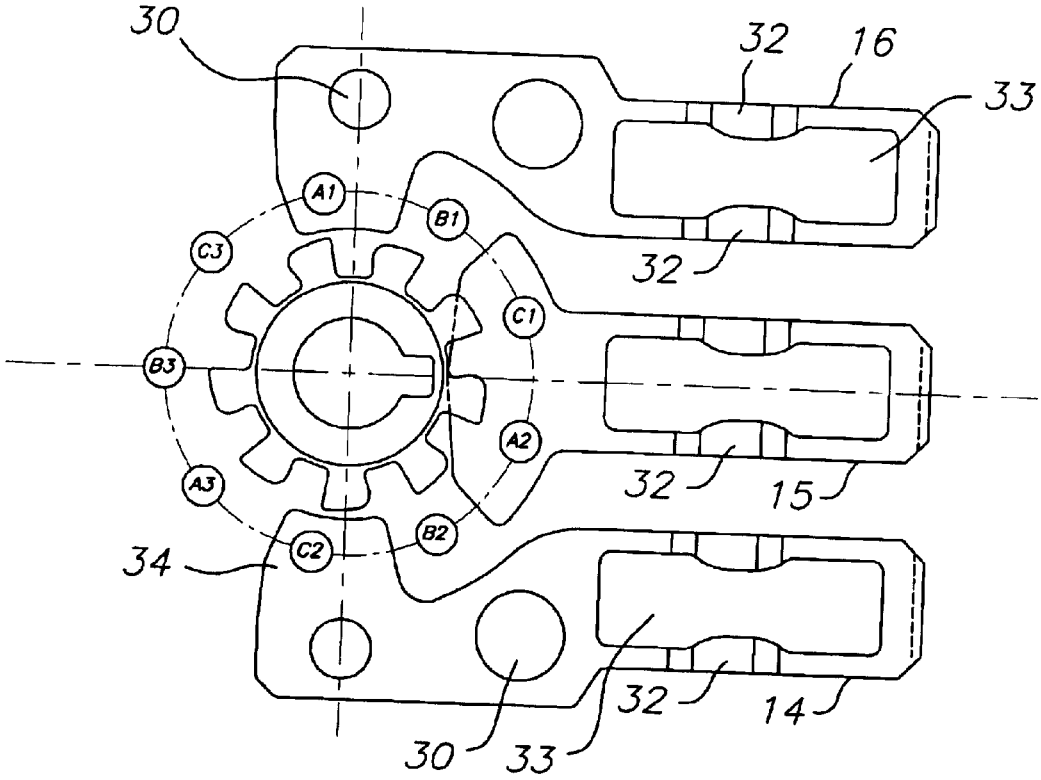
FIG. 9 is a semi-schematic illustration of the switching positions for an ON-ON-OFF switch.

FIG. 9 illustrates contact positions for the contact member on the respective terminals. This is a schematic illustration with small diameter circles labeled A1, B1, etc., representing the contact location for the respective fingers on the contact member as the switch is operated. The arrangement is suitable for a three-state, ON-ON-OFF, switch. Thus, in one state of the switch, finger A1 is in electrical contact with terminal 16 (referred to as the upper terminal, as illustrated in FIG. 9). The second finger A2 is in electrical contact with the center terminal. The third finger A3, is not in electrical contact with any terminal. Thus, in this state the switch is ON with an electrical circuit completed between the upper and central terminals.

Upon one actuation of the switch, the fingers advance 40° to the B positions. As seen in this illustration, none of the fingers B1, B2 or B3 is in electrical contact with any of the contact pads on the terminals. Thus, the switch is OFF.

Upon an additional actuation of the switch, the fingers advance another 40° to the C positions. Now, one of the fingers C1 is in contact with the center terminal, a finger C2 is in contact with the lower terminal and the third finger C3 is not in electrical contact with any terminal. As in this state, there is a completed electrical circuit between the center and lower terminals and the switch is ON in a second state.

It will be apparent that upon an additional actuation of the switch, the fingers advance another 40° (e.g. with the contact C1, then the position of A2 is illustrated in FIG. 9) and the switch is advanced to its initial ON state.

Figure 10:
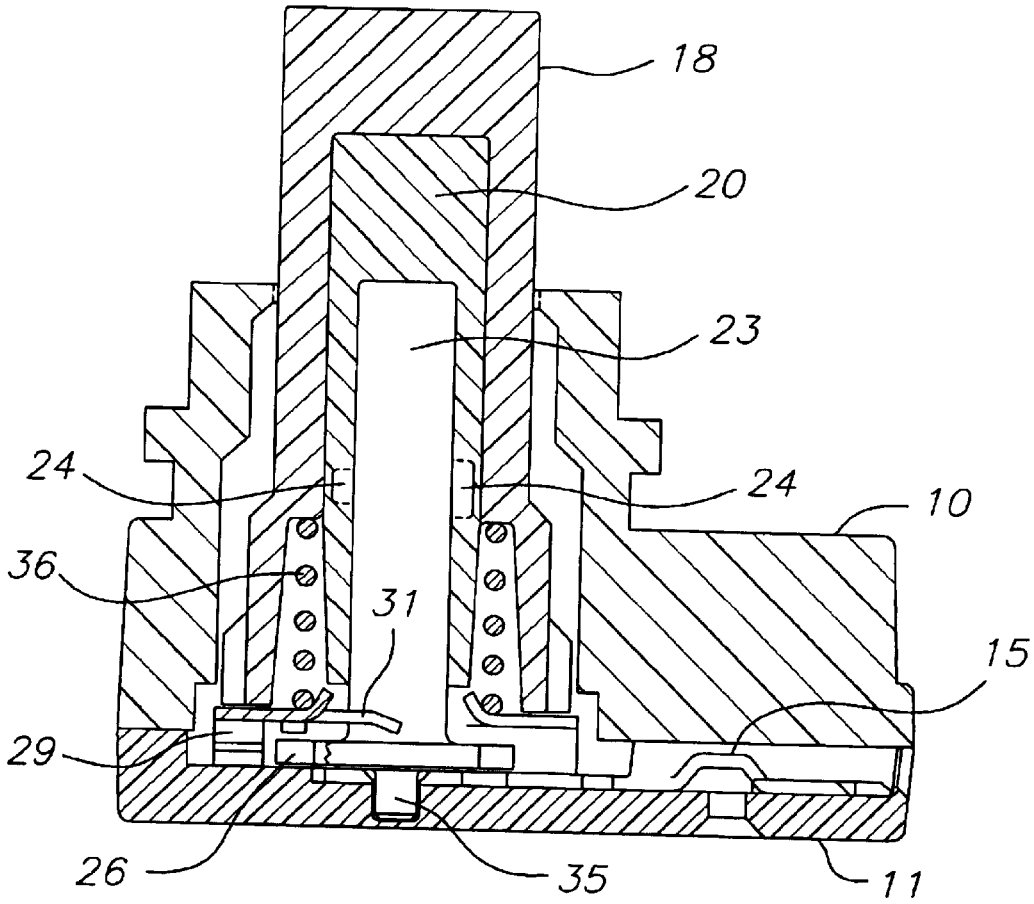
FIG. 10 is a partial longitudinal cross-section through the switch when the plunger is depressed.
Figure 11:
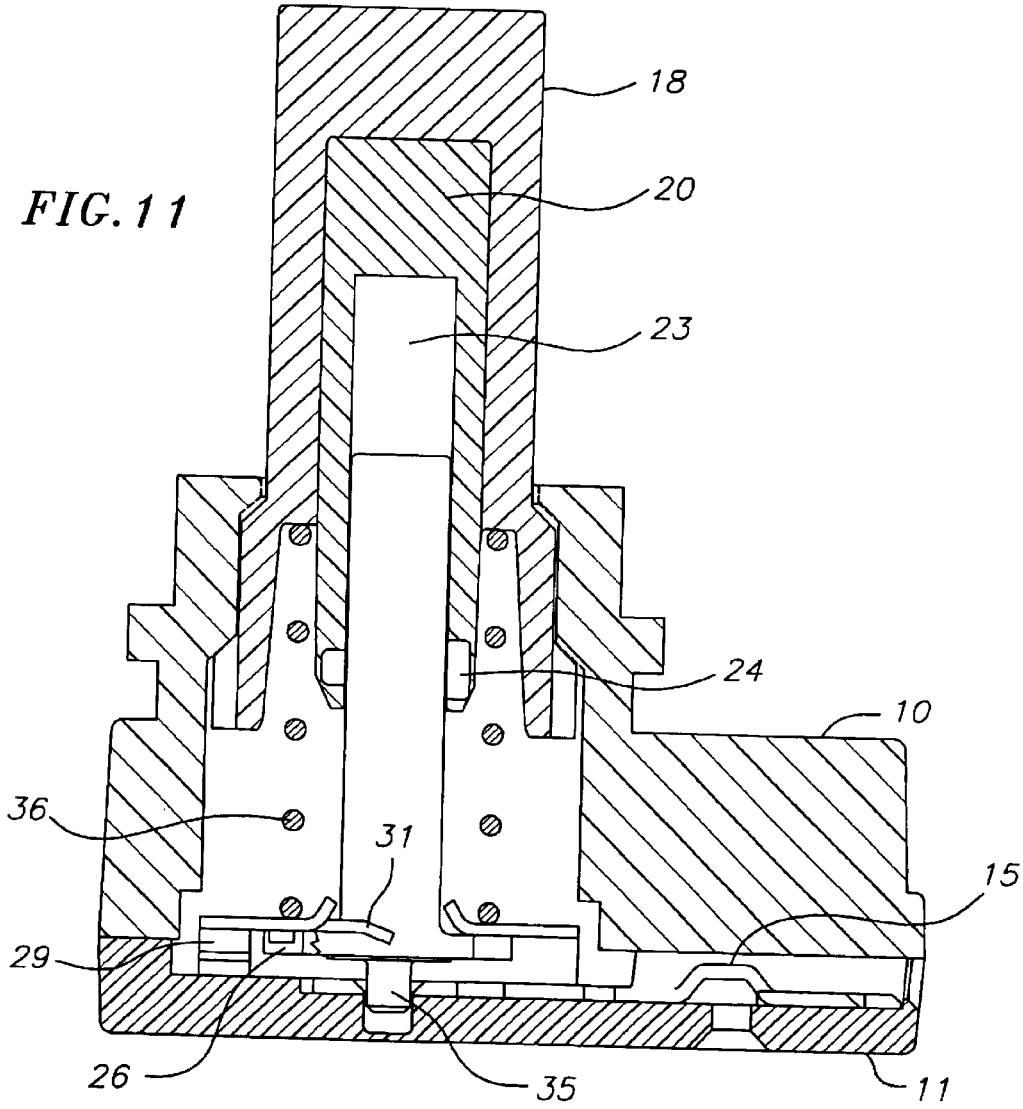
FIG. 11 is a partial longitudinal cross-section through the switch when the plunger is released or retracted.

FIG. 10 illustrates in longitudinal cross section the state of the switch when the plunger is depressed. FIG. 11 is similar, but with the plunger released. These illustrations are semi-schematic since the vertical positions of the plunger, etc., are shown without rotation being shown.

As the plunger is depressed, it commences compressing a coil spring 36, one end of which is in an annular channel in the plunger outside the insert. The other end of the spring bears against the electrical contact member 27 biasing it toward the terminals for good electrical contact. The spring also serves as a return spring for the plunger when pressure on the plunger is released.

As the plunger is depressed, a longitudinal portion of the slots 22 travels along the pins 24 extending laterally from the shaft. As the plunger reciprocates further, the pins enter the diagonal or spiral portion of the slots which causes the shaft to rotate. Furthermore, the upper face or camming surface of the slots moves the shaft downwardly, reducing and eliminating engagement between the teeth on the shaft and the pawl extending downwardly from the contact member. The spacing between teeth (i.e., circumferential width of the teeth) can be such that there is very little, if any contact, between the pawl and the tooth during this rotation of the shaft. Even if there is some contact, the angles and flexibility of the pawl finger are such that the pawl can ride over the trailing edge of a tooth. At the end of a depression stroke of the plunger, as illustrated in FIG. 10, the pawl is completely disengaged from the teeth.

When the plunger is released, the lower edge or camming surface of the slots engages the pins on the shaft and simultaneously lift the shaft toward the contact member and rotate the shaft so that the leading edge of a tooth engages the pawl. Thus, the tooth causes rotation of the contact member. The tooth engaged with the pawl advances the contact member 40° (for the nine tooth embodiment illustrated) causing a change of state of the switch (from ON-to-OFF, for example) as the plunger reciprocates towards its released position.

It will be noted that as the plunger is depressed, the teeth do not engage the pawl to change the state of the switch. This is desirable for a more stable switch.

The length and/or the angle of the spiral slots acting on the pins, determine the angles through which the shaft oscillates in rotation. As a matter of practice, it is desirable to rotate the shaft more than 40° during the depression stroke. Thus, when the shaft returns during release, there is some free travel before a tooth engages the pawl and commences rotation of the contact member. Thus, the length of the diagonal portion of the slots preferably extends more than 40° around the insert.

The pins enter the longitudinal portion of the slot toward the end of the release stroke and the wall of this portion of the slot determines the final position of the tooth relative to the switch housing, and hence the rotational position of the pawl and electrical contact fingers on the terminals. The various keys used during assembly of the switch assure appropriate alignment of all of the parts so that the contact fingers engage the terminals in the appropriate location.

Figure 12:
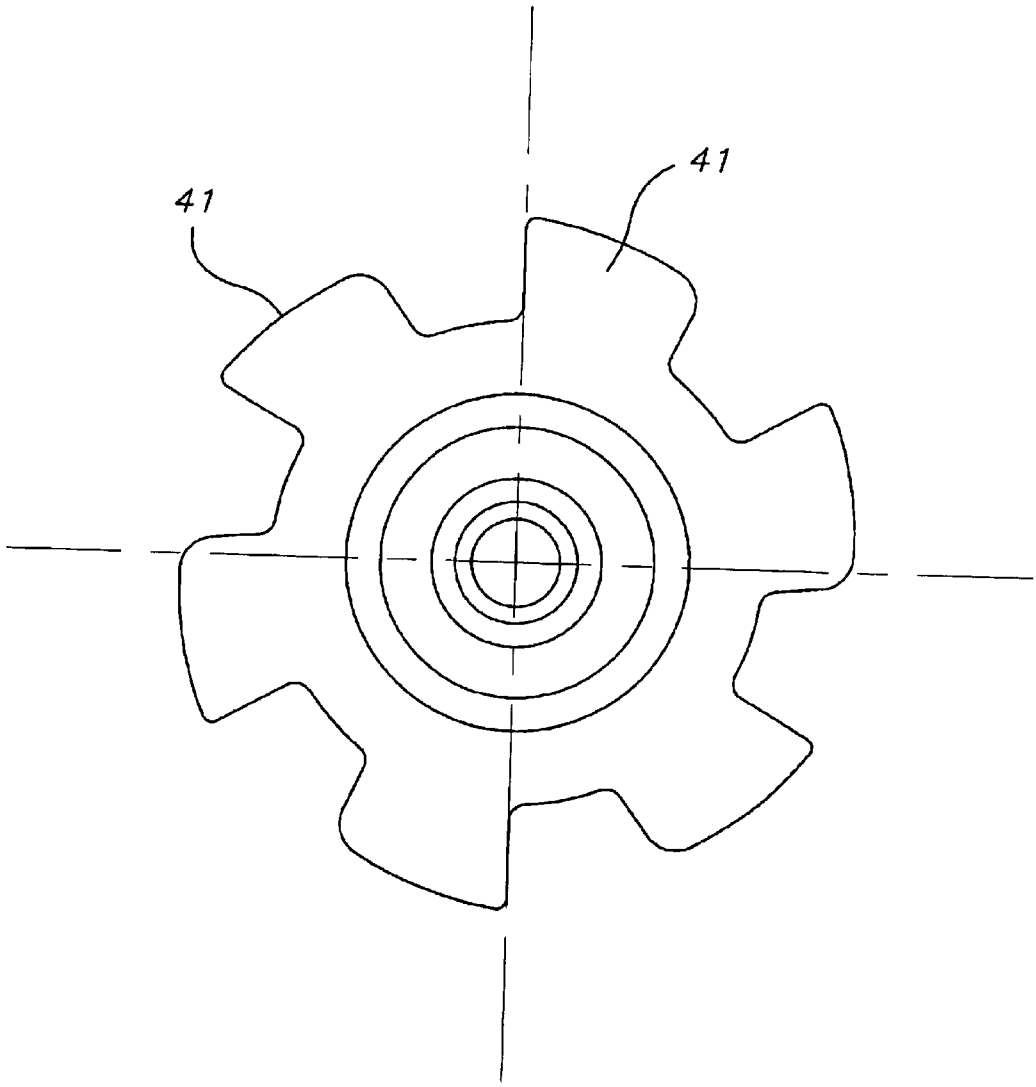
FIG. 12 is an end view of another embodiment of shaft for a pushbutton switch.

In a simple ON-OFF switch, it is appropriate to use an even number of teeth on the shaft, such as the embodiment of FIG. 12 wherein there are six-teeth 41 radiating from the lower end of the shaft. In such an embodiment, the length and/or angle of the spiral slot in the plunger is sufficiently longer that the shaft oscillates in rotation somewhat more than 60°. This is enough that in the ON state of the switch all three contact fingers on the contact member are in electrical contact with a respective terminal. Upon 60° rotation of the contact member, none of the contact fingers are in contact with any of the terminals and it switches OFF.

Other variations of design are quite feasible in such a pushbutton switch. For example, instead of a plurality of more or less square teeth radiating from a flange at the lower end of the shaft, one may use teeth that are more typical of a rachet. In such an embodiment, which is not illustrated, there is a circular flange and more or less triangular teeth radiate above the upper surface of the flange. Such a shaft operates similarly, but is somewhat more difficult to injection mold.

The shaft in the illustrated embodiment has two laterally extending pins with different diameters. This is merely an aid for correct assembly when there are an odd number of teeth on the shaft. The pins and slots may have the same size if other means are employed for assuring correct assembly, or if the number of teeth is even, such as in the six tooth embodiment illustrated. A second pin as also not necessary, it simply balances the loading. A switch is operable when only one set of pin and slot is used.

Figure 6:
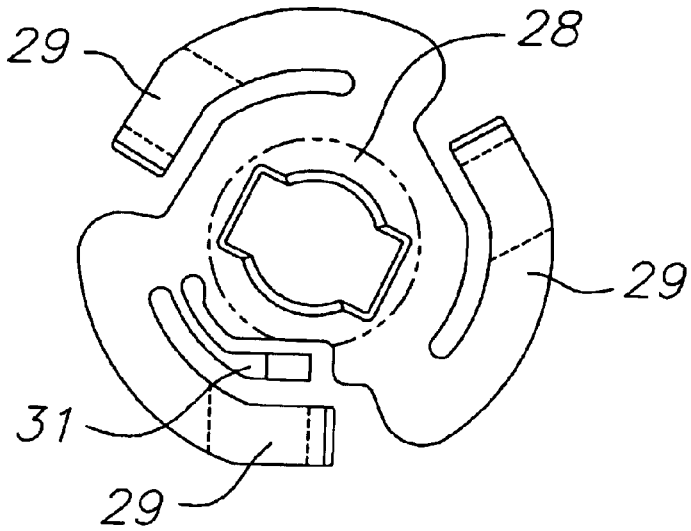
FIG. 6 is a view of the face of an electrical contact member.
Figure 7:
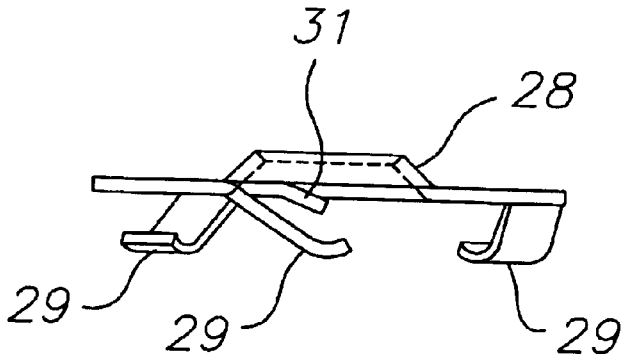
FIG. 7 is a side view of the contact member illustrated in FIG. 6.
Figure 8:
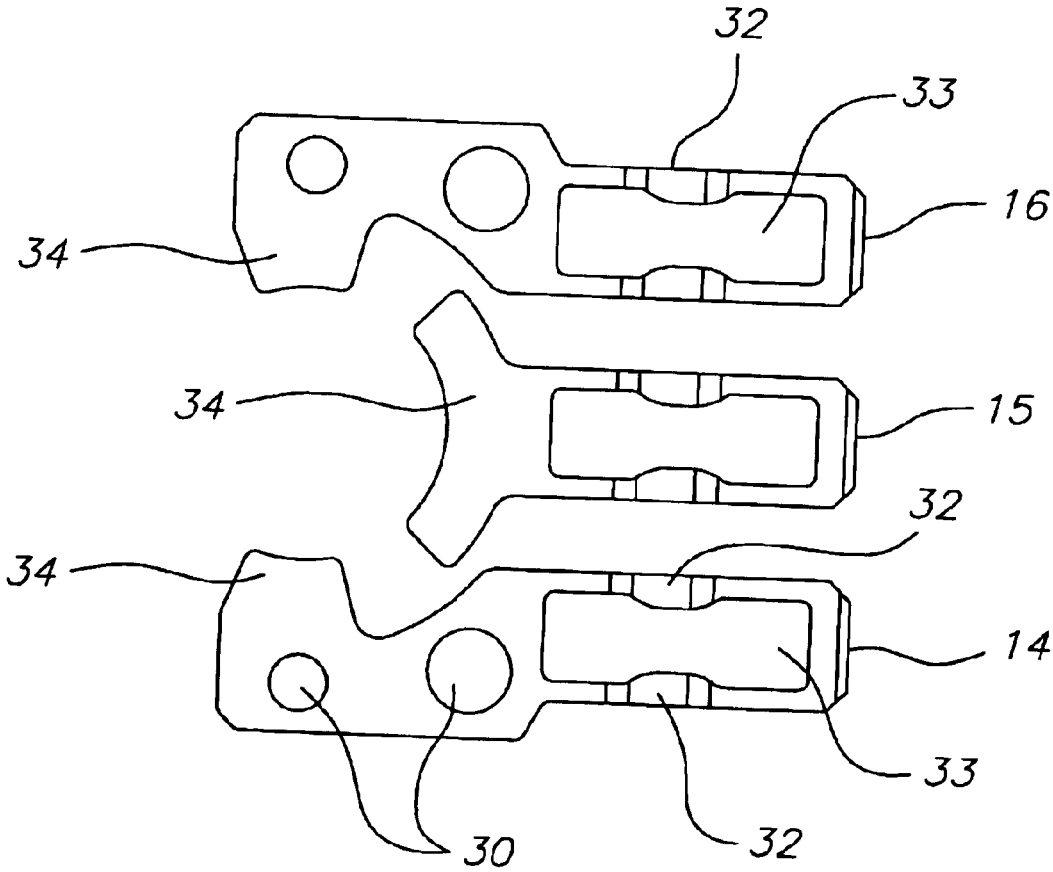
FIG. 8 is a face view of electrical terminals in the switch housing.
Figure 14:
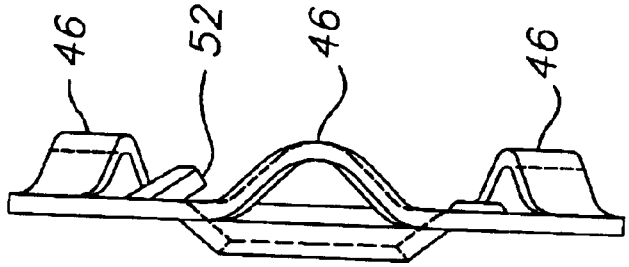
FIG. 14 is a side view of the contact member illustrated in FIG. 13.
Figure 13:
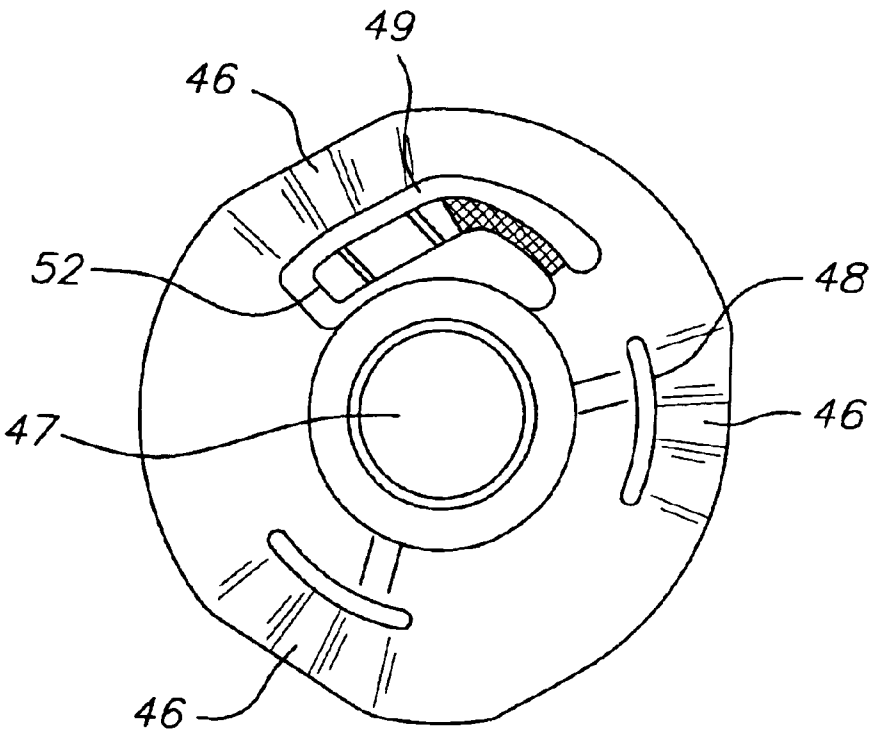
FIG. 13 is a view of the face of a second embodiment of electrical contact member for a pushbutton switch.

Another variation is illustrated in FIGS. 13 and 14, which show a somewhat different structure of the electrical contact member. In this embodiment, instead of circumferentially extending fingers (such as illustrated in the embodiment in FIGS. 6 and 7) there are three circumferentially spaced apart "bumps" 46 on the bottom on the contact member for electrical contact with terminals in the housing. The contact member is basically a circular disk with a central hole 47 through which a pin on the end of the shaft fits to engage a hole in the cover. There are three circumferentially extending slits 48 through the face of the disk. Each of the bumps is stamped or coined out of the plane of the disk in a generally U-shape between the outer edge of such a slit and the perimeter of the disk.

Two of the slits 48 are short circumferential arcs. A third slit 49 has an elongated U-shape to nearly surround a finger 51. At least the end of the finger is bent downwardly to form a pawl 52 extending below the plane of the disk. The pawl finger can be stamped or coined thinner than the balance of the contact member for enhanced flexibility. Thus, although structurally different from the embodiment illustrated in FIGS. 6 and 7, this contact member is functionally equivalent.

What is claimed is:

1. A pushbutton switch comprising:

a housing;

electrical terminals in the housing;

a plunger mounted for reciprocation in the housing;

a rotatable contact member for contacting the terminals;

a shaft in the plunger free to reciprocate relative to the plunger;

a plurality of teeth on an end of the shaft;

a pawl on the contact member engaging a tooth on the shaft;

means for rotating the contact member in one direction and preventing rotation of the contact member in the opposite direction in response to oscillation of the shaft comprising means for disengaging the teeth from the pawl upon depression of the plunger.

2. A pushbutton switch according to claim 1 wherein the means for disengaging comprises a diagonal camming surface in the plunger.

3. A pushbutton switch comprising:

a housing;

electrical terminals in the housing;

a plunger mounted for reciprocation in the housing;

a rotatable contact member comprising a disk having a plurality of circumferentially extending, downwardly extending fingers for contacting respective terminals and a downwardly extending pawl for engaging a tooth on the shaft;

a shaft in the plunger free to reciprocate relative to the plunger;

means for oscillating rotation of the shaft in response to movement of the plunger;

means for rotating the contact member in one direction and preventing rotation of the contact member in the opposite direction in response to oscillation of the shaft.

4. A pushbutton switch comprising:

a housing;

electrical terminals fixed in the housing;

a plunger mounted for reciprocation in the housing, including a camming surface in the plunger;

a rotatable contact member including a plurality of contacts around the perimeter of the contact member in electrical contact with at least a portion of the terminals in at least one rotational position of the contact member;

a spring between the contact member and the plunger;

a shaft inside the plunger including a camming pin engaging the camming surface in a depressed position of the plunger;

a plurality of teeth radiating from an end of the shaft, the radiating teeth fitting between a central portion of the contact member and the terminals; and a pawl extending from the contact member having an end engaging a tooth on the shaft.

5. A pushbutton switch according to claim 4 wherein the contact member comprises a plurality of circumferentially extending fingers around the perimeter of the contact member, at least a portion of the fingers being in contact with at least a portion of the terminals in at least one rotational position of the contact member.

6. A pushbutton switch according to claim 4 wherein the contact member comprises a generally circular disk with a plurality of downwardly extending projections around the perimeter of the contact member, at least a portion of the projections being in contact with at least a portion of the terminals in at least one rotational position of the contact member.

7. A pushbutton switch according to claim 4 wherein the pawl extends downwardly from the contact member and fits between adjacent teeth on the shaft.

8. A pushbutton switch according to claim 4 wherein the contact member comprises a generally circular disk with an axial hole accommodating an end portion of the shaft and the contacts around the perimeter extend downwardly toward the terminals.

9. A pushbutton switch according to claim 4 comprising a slot in the plunger, and a pin on the shaft engaging the slot for moving the shaft upon reciprocation of the plunger.

10. A pushbutton switch according to claim 9 wherein the slot has a lower longitudinally extending portion and an upper diagonally extending portion.

11. A pushbutton switch according to claim 4 wherein the pawl is elastically flexible.

12. A pushbutton switch comprising:

a housing;

three electrical terminals fixed in the housing;

a pushbutton plunger mounted for reciprocation in the housing, including a lower longitudinal slot ending in an upper spiral camming slot in the plunger;

a rotatable contact member including a plurality of contacts around the perimeter of the contact member in electrical contact with at least a portion of the terminals in at least one rotational position of the contact member;

a spring biasing the contact member toward the terminals and biasing the plunger toward a release position;

a shaft inside the plunger including a camming pin in the longitudinal slot and/or spiral camming slot;

a flange on the end of the shaft with a plurality of teeth, the flange fitting between a central portion of the contact member and the terminals; and a spring finger extending downwardly from a mid-portion of the contact member with an end engaging a tooth on the flange.

13. A pushbutton switch according to claim 12 wherein the teeth each have a radially extending leading edge for engaging the spring finger.

14. A pushbutton switch according to claim 12 wherein the teeth are tabs extending radially from the lower end of the shaft.

15. A pushbutton switch according to claim 12 wherein the contacts on the contact member comprise a plurality of circumferentially extending fingers extending downwardly from the contact member.

16. A pushbutton switch according to claim 12 wherein the contacts on the contact member comprise a plurality of downwardly extending projections and the pawl comprises a flexible finger.

17. A pushbutton switch comprising:

a housing;

a plurality of electrical terminals fixed in the housing;

a pushbutton plunger mounted solely for reciprocation in the housing, including a spiral camming surface in the plunger;

a rotatable contact member including a plurality of contacts around the perimeter of the contact member for making or breaking electrical contact with at least a portion of the terminals;

means for biasing the contact member toward the terminals and biasing the plunger toward a return position;

a shaft inside the plunger including a camming pin for engaging the spiral camming surface;

a flange on the end of the shaft with a plurality of radiating teeth, the flange fitting between a portion of the contact member and the terminals; and a downwardly extending pawl on the contact member for engaging a tooth on the flange for rotation of the contact member in response to rotation of the shaft.

18. A pushbutton switch according to claim 17 wherein the camming surface comprises a slot with an upper spirally extending portion and a lower longitudinally extending portion.

19. A pushbutton switch according to claim 17 wherein the contacts on the contact member comprise a plurality of circumferentially extending fingers extending downwardly from the contact member.

20. A pushbutton switch according to claim 17 wherein the number of teeth is nine.

21. A pushbutton switch according to claim 17 wherein the pawl is elastically flexible.

* * * * *